US009353647B2

(12) United States Patent
Bordne et al.

(10) Patent No.: US 9,353,647 B2
(45) **Date of Patent: *May 31, 2016**

(54) WIDE DISCOURAGER TOOTH

(71) Applicant: General Electric Company, Schenectady, NY (US)

(72) Inventors: Christopher Mark Bordne, Marblehead, MA (US); Duane Howard Anstead, Fairfield, OH (US); James John Luz, Tewksbury, MA (US)

(73) Assignee: General Electric Company, Schenectady, NY (US)

( * ) Notice: Subject to any disclaimer, the term of this patent is extended or adjusted under 35 U.S.C. 154(b) by 321 days.

This patent is subject to a terminal disclaimer.

(21) Appl. No.: 13/713,018

(22) Filed: Dec. 13, 2012

(65) Prior Publication Data

US 2014/0099188 A1 Apr. 10, 2014

Related U.S. Application Data

(60) Provisional application No. 61/639,560, filed on Apr. 27, 2012.

(51) Int. Cl.
*F16J 15/447* (2006.01)
*F01D 25/18* (2006.01)
*F01D 25/20* (2006.01)

(52) U.S. Cl.
CPC ..... *F01D 25/183* (2013.01); *F01D 25/18* (2013.01); *F01D 25/20* (2013.01)

(58) Field of Classification Search
CPC ..... F16J 15/442; F16J 15/164; F16J 15/3292; F16J 15/445; F16J 15/3288; F01D 25/183; F01D 25/18; F01D 25/20
USPC ..... 277/412, 303; 415/230, 231, 170.1, 415/174.5
See application file for complete search history.

(56) References Cited

U.S. PATENT DOCUMENTS 3,085,809 A 4/1963 Cooper
3,501,089 A * 3/1970 Alford ..... 184/6.11
(Continued)

FOREIGN PATENT DOCUMENTS

EP 1890005 2/2008
EP 1895108 3/2008
(Continued)

OTHER PUBLICATIONS

European Search Report issued in connection with corresponding EP Application No. EP13165240.6 on Apr. 17, 2014.
(Continued)

*Primary Examiner* — Kristina Fulton
*Assistant Examiner* — Nathan Cumar
(74) *Attorney, Agent, or Firm* — General Electric Company; Pamela A. Kachur

(57) ABSTRACT

Oil sump seal pressurization apparatus for turbine engines are disclosed. An example oil sump seal pressurization apparatus may include a non-rotating oil sump housing a bearing; an oil seal isolating an interior of the oil sump; a passage arranged to supply pressurization air to an outward side of the oil seal; a drain arranged to allow draining of oil and venting of at least some of the pressurization air, the drain being positioned axially between the passage and the oil seal; a wide discourager tooth disposed on the shaft and extending radially outward towards a non-rotating land, which may be disposed axially between the passage and the drain, the wide discourager tooth being spaced apart from the land in a radial direction by a gap, the wide discourager tooth including an upper surface; and/or an adjacent tooth disposed on the shaft and extending radially outward from the shaft.

18 Claims, 4 Drawing Sheets

(56) References Cited

U.S. PATENT DOCUMENTS

| | | | | | |
|---|---|---|---|---|---|
| 3,527,054 | A | | 9/1970 | Hemsworth | |
| 3,528,241 | A | | 9/1970 | Venable et al. | |
| 3,537,713 | A | * | 11/1970 | Matthews et al. | 277/415 |
| 3,989,410 | A | | 11/1976 | Ferrari | |
| 4,190,397 | A | * | 2/1980 | Schilling et al. | 415/112 |
| 4,397,471 | A | * | 8/1983 | Feldman et al. | 277/412 |
| 4,645,415 | A | | 2/1987 | Hovan et al. | |
| 5,090,865 | A | | 2/1992 | Ramachandran et al. | |
| 5,190,440 | A | | 3/1993 | Maier et al. | |
| 5,218,816 | A | | 6/1993 | Plemmons et al. | |
| 5,301,957 | A | | 4/1994 | Hwang et al. | |
| 6,350,102 | B1 | | 2/2002 | Bailey et al. | |
| 6,398,486 | B1 | | 6/2002 | Storey et al. | |
| 6,470,666 | B1 | | 10/2002 | Przytulski et al. | |
| 6,481,959 | B1 | | 11/2002 | Morris et al. | |
| 6,761,034 | B2 | | 7/2004 | Niday et al. | |
| 7,677,048 | B1 | | 3/2010 | Brostmeyer et al. | |
| 2003/0011135 | A1 | * | 1/2003 | Meacham | 277/408 |
| 2003/0097872 | A1 | | 5/2003 | Granitz et al. | |
| 2003/0110778 | A1 | * | 6/2003 | Karafillis et al. | 60/785 |
| 2007/0193276 | A1 | * | 8/2007 | Corattiyil et al. | 60/782 |
| 2010/0209229 | A1 | | 8/2010 | Propheter-Hinckley et al. | |
| 2010/0254807 | A1 | | 10/2010 | Smoke et al. | |
| 2013/0283757 | A1 | * | 10/2013 | Bordne et al. | 60/39.08 |

FOREIGN PATENT DOCUMENTS

| | | | |
|---|---|---|---|
| EP | 1936123 | A2 | 6/2008 |
| EP | 2657465 | A1 | 10/2013 |
| GB | 2152148 | A1 | 7/1985 |
| WO | 2001/031235 | A2 | 5/2001 |
| WO | 2006/059981 | A1 | 6/2006 |

OTHER PUBLICATIONS

US Office Action issued in connection with corresponding U.S. Appl. No. 13/713,013 on Dec. 2, 2015.

European Search Report issued in connection with related EP Application No. 13165398.2 on Jul. 26, 2013.

US Office issued in connection with related U.S. Appl. No. 13/713,013 on Nov. 26, 2014.

US Office issued in connection with related U.S. Appl. No. 13/713,013 on May 7, 2015.

Chinese Office issued in connection with related CN Application No. 201310149679.6 on Jul. 6, 2015.

U.S. Appl. No. 13/713,013, filed Dec. 13, 2012, Christopher Mark Bordne et al.

* cited by examiner

WIDE DISCOURAGER TOOTH

CROSS REFERENCE TO RELATED APPLICATION

This application claims the benefit of U.S. Provisional Application No. 61/639,560, filed Apr. 27, 2012, which is incorporated by reference herein in its entirety.

The subject matter of this application may be related to the subject matter of U.S. Patent Application No. 61/639,315, titled "APPARATUS AND METHOD FOR MITIGATING VORTEX PUMPING EFFECT UPSTREAM OF OIL SEAL," filed on even date herewith, which is incorporated by reference herein its entirety.

BACKGROUND

The subject matter disclosed herein relates generally to apparatuses and methods for retaining fluid lubricant, such as oil, in an oil sump and/or its drain path. More specifically, but not by way of limitation, some example embodiments relate to apparatuses and methods for maintaining design gaps during axial excursions of a shaft while also improving the limitation of oil leakage, for example from in a sump of a turbine engine.

In a turbine engine, air is pressurized in a compressor and mixed with fuel in a combustor for generating hot combustion gases which flow downstream through turbine stages. These turbine stages extract energy from the combustion gases. A high pressure turbine includes a first stage nozzle and a rotor assembly including a disk and a plurality of turbine blades. The high pressure turbine first receives the hot combustion gases from the combustor and includes a first stage stator nozzle that directs the combustion gases downstream through a row of high pressure turbine rotor blades extending radially outwardly from the first rotor disk. In a two stage turbine, a second stage stator nozzle is positioned downstream of the first stage blades followed in turn by a row of second stage turbine blades extending radially outwardly from a second rotor disk. The stator nozzles turn the hot combustion gas in a manner to enhance extraction at the adjacent downstream turbine blades.

The first and second rotor disks are joined to the compressor by a corresponding high pressure rotor shaft for powering the compressor during operation. The high pressure turbine powers rotation of the compressor to create compressed air for combustion, thus continuing the process. A multi-stage low pressure turbine follows axially the two stage high pressure turbine and is typically joined by a second shaft coaxial with the first shaft to a fan disposed upstream from the compressor in a typical turbo fan aircraft engine configuration for powering an aircraft in flight.

As the combustion gasses flow downstream through the turbine stages, energy is extracted therefrom and the pressure of the combustion gas is reduced while providing fan rotation for aviation thrust. Alternatively, the combustion gas is used to power the compressor and a turbine output shaft for power and marine use. In this manner, fuel energy is converted to mechanical energy of the rotating shaft to power the compressor and supply compressed air needed to continue the process.

During rotation of the core of the turbine engine, and at some operating temperatures, axial excursions of the rotor shaft and parts connected thereto may sometimes occur. Seal teeth structures have been used to seal areas of differential pressure or oil and air and maintain pressure for pressurized seals. Ensuring that a design gap over a discourager tooth is always maintained during these axial excursions often required extending the opposed sealing surface, which could be problematic to the design of surrounding components.

Of additional concern, at some operational design altitudes, for example 51,000 feet, air is of very low density. Such thin air may not have enough force against the direction of oil seals so as to fully inhibit leakage from the sump.

The problems: Oil leakage across seals may be disadvantageous for a turbine engine. Axial excursions of the rotor and connected structures may cause an associated sealing structure to lose a design or seal gap with an opposed land. In some oil sump configurations, excessive pressure differential around an oil sump may cause undesirable oil leakage.

BRIEF DESCRIPTION

At least one solution for the above-mentioned problem(s) is provided by the present disclosure to include example embodiments, provided for illustrative teaching and not meant to be limiting.

Some example embodiments according to at least some aspects of the present disclosure may involve an oil sump and the prevention of oil leakage from the sump, for example through a sump seal. Pressurized air flow may be directed through a pathway and over a widened discourager tooth. Some example widened discourager teeth may include a tip having an extended axial length for maintaining a design gap during axial excursions of the rotor shaft, to which the discourager tooth is connected. Some example widened discourager teeth may provide an elongated region of high velocity air flowing past, which may induce higher impulse. This higher impulse may approach oil particles which may have moved beyond an oil seal (e.g., a labyrinth seal) and may be more capable of changing oil particle direction to prevent oil leakage over the discourager tooth.

An example oil sump seal pressurization apparatus for a turbine engine according to at least some aspects of the present disclosure may include a non-rotating oil sump housing a bearing, the bearing supporting a rotatable shaft; an oil seal at least partially isolating an interior of the oil sump, the oil seal operatively acting between a non-rotating structural member of the sump and the rotatable shaft; a passage arranged to supply pressurization air to an outward side of the oil seal with respect to the oil sump; a drain arranged to allow draining of oil and venting of at least some of the pressurization air, the drain being positioned axially between the passage and the oil seal; a discourager tooth disposed on the shaft and extending radially outward towards a non-rotating land, the land being disposed axially between the passage and the drain, the discourager tooth being spaced apart from the land in a generally radial direction by a gap having a width, the discourager tooth including an upper surface having a width; and/or a first adjacent tooth disposed on the shaft and extending radially outward from the shaft. The discourager tooth width may be at least about 1.5 times a width of the first adjacent tooth.

An example oil sump seal pressurization apparatus for a turbine engine according to at least some aspects of the present disclosure may include a non-rotating oil sump housing, a bearing, the bearing supporting a rotatable shaft; an oil seal at least partially isolating an interior of the oil sump, the oil seal operatively acting between a non-rotating structural member of the sump and the rotatable shaft; a passage arranged to supply pressurization air to an outward side of the oil seal with respect to the oil sump; a drain arranged to allow draining of oil and venting of at least some of the pressurization air, the drain being positioned axially between the passage and the oil seal; and/or a discourager tooth disposed on the shaft and extending radially outward towards a non-rotating land, the land being disposed axially between the passage and the drain, the discourager tooth being spaced apart from the land in a generally radial direction by a gap having a width, the discourager tooth including an upper surface having a width.

An example oil sump seal pressurization apparatus for a turbine engine according to at least some aspects of the present disclosure may include a non-rotating oil sump housing a bearing, the bearing supporting a rotatable shaft; an oil seal at least partially isolating an interior of the oil sump, the oil seal operatively acting between a non-rotating structural member of the sump and the rotatable shaft; a passage arranged to supply pressurization air to an outward side of the oil seal with respect to the oil sump; a sump pressurization cavity disposed at least partially around the oil sump, the sump pressurization cavity comprising a volume arranged to supply the pressurization air to the passage; a non-rotatable windage shield disposed within the sump pressurization cavity between the volume and a rotatable arm disposed on the shaft; a pressurization tooth fluidicly interposing the passage and the rotatable arm, the pressurization tooth restricting flow of the pressurization air from the passage towards the rotatable arm; a drain arranged to allow draining of oil and venting of at least some of the pressurization air, the drain being positioned axially between the passage and the oil seal; and/or a discourager tooth disposed on the shaft and extending radially outward towards a non-rotating land, the land being disposed axially between the passage and the drain, the discourager tooth being spaced apart from the land in a generally radial direction by a gap having a width, the discourager tooth including an upper surface having a width.

All of the above outlined features are to be understood as exemplary only and many more features and objectives of the invention may be gleaned from the disclosure herein. Therefore, no limiting interpretation of this summary is to be understood without further reading of the entire specification, claims, and drawings included herewith.

BRIEF DESCRIPTION OF THE DRAWINGS

The subject matter for which patent claim coverage is sought is particularly pointed out and claimed herein. The subject matter and embodiments thereof, however, may be best understood by reference to the following description taken in conjunction with the accompanying drawing figures in which:

DETAILED DESCRIPTION

Figure 1:
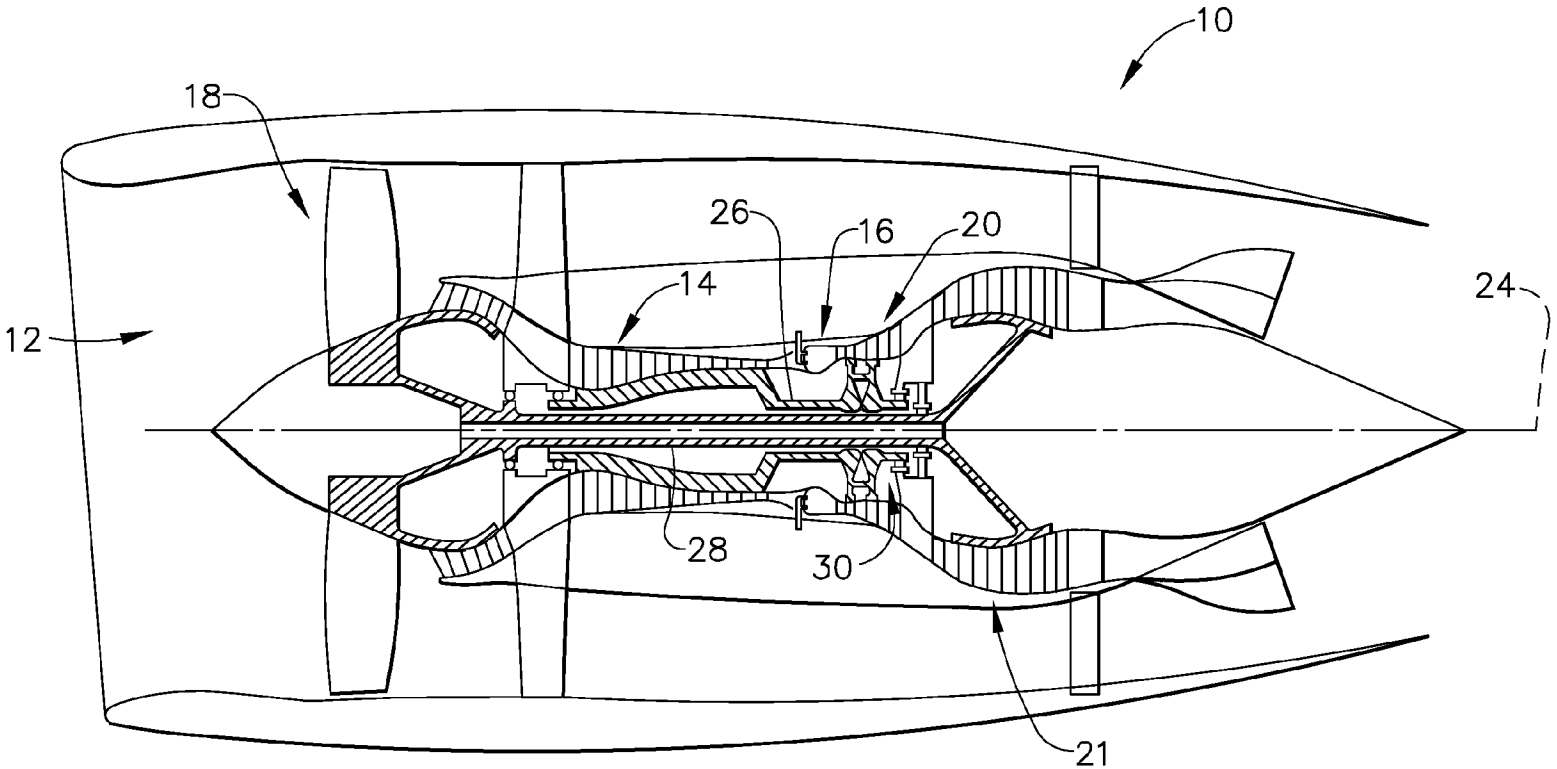
FIG. 1 is a side section view of an example turbine engine.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Reference now will be made in detail to embodiments provided, one or more examples of which are illustrated in the drawings. Each example is provided by way of explanation, not limitation of the disclosed embodiments. In fact, it will be apparent to those skilled in the art that various modifications and variations can be made in the present embodiments without departing from the scope or spirit of the disclosure. For instance, features illustrated or described as part of one embodiment can be used with another embodiment to still yield further embodiments. Thus it is intended that the present invention covers such modifications and variations as come within the scope of the appended claims and their equivalents.

Some example embodiments according to at least some aspects of the present disclosure may relate to a gas turbine engine, wherein a combustor burns fuel mixed with compressed air and discharges a hot combustion gas into a high pressure turbine. Apparatus and methods according to at least some aspects of the present disclosure may aid to limit the problems associated with axial excursions of a rotor and associated components. Additionally, apparatus and methods according to at least some aspects of the present disclosure may aid to limit oil leakage through various seal types, including but not limited to, a labyrinth oil seal at an oil sump.

The terms fore (or forward) and aft are used with respect to the engine axis and generally mean toward the front of the turbine engine or the rear of the turbine engine in the direction of the engine axis, respectively.

FIGS. 1-4 illustrate various example oil sump seal pressurization apparatuses and methods of maintaining oil within an oil sump and/or limiting the effects of axial excursions of the rotor and a discourager tooth connected thereto.

Referring initially to FIG. 1, a schematic side section view of a gas turbine engine 10 is shown having an engine inlet end 12, a compressor 14, a combustor 16 and a multi-stage high pressure turbine 20. The gas turbine 10 may be used for aviation, power generation, industrial, marine, or like applications. The gas turbine 10 is generally axis-symmetrical about axis 24. Depending on the usage, the engine inlet end 12 may alternatively contain multistage compressors rather than a fan. In operation, air enters through the air inlet end 12 of the engine 10 and moves through at least one stage of compression where the air pressure is increased and directed to the combustor 16. The compressed air is mixed with fuel and burned providing the hot combustion gas which exits a combustor 16 toward the high pressure turbine 20. At the high pressure turbine 20, energy is extracted from the hot combustion gas causing rotation of turbine blades which in turn cause rotation of the high pressure shaft 26, which passes toward the front of the engine to continue rotation of the one or more compressors 14. A second shaft, low pressure shaft 28, mechanically couples a low pressure turbine 21 and a turbo fan 18 or inlet fan blades, depending on the turbine design.

The high pressure shaft 26 rotates about the axis 24 of the engine. The high pressure shaft 26 extends through the turbine engine 10 and is supported by bearings. The bearings operate in oil sumps to cool parts during the high speed revolution. Fluid leakage in and around rotating parts may significantly increase fuel consumption and reduce engine efficiency resulting in undesirable operating parameters for the turbine engine. Additionally, high pressure gasses, such as combustion gasses within the turbine and compressor discharge area, may leak from high pressure areas to low pressure areas and controlling such leakage is preferred. Control or inhibition of such leakage is performed in a variety of manners including, for example, labyrinth seals and brush seals positioned between areas of differential pressure. Over time, however, increased exposure to these high pressure and thermal areas may result in loss of seal effectiveness.

In gas turbine engines it is frequently necessary or desirable to isolate a volume, which may include one or more rotating parts in order to confine a fluid, such as oil, and to prevent such fluid from flowing into adjacent areas or flowing out of the volume. For example, in a gas turbine engine, it may be necessary to confine a liquid lubricant associated with shaft bearings to a volume surrounding the bearing in order to prevent amounts of the fluid or oil from leaking from the volume or sump. An exemplary sump area 30 is depicted at an aft end of the shaft 26. The sump area 30 includes a widened discourager tooth further to compensate for axial movement or excursions of the shaft 26 and prevent oil leakage. Although an example embodiment is described for this specific area, similar apparatus may be used with or applied to a multitude of locations. Such description should therefore not be considered limiting. In oil sump structures, pressurized air is utilized to pass around or through the sump area in order to pressurize seals and prevent leakage as well as cool oil or operating components.

Figure 2:
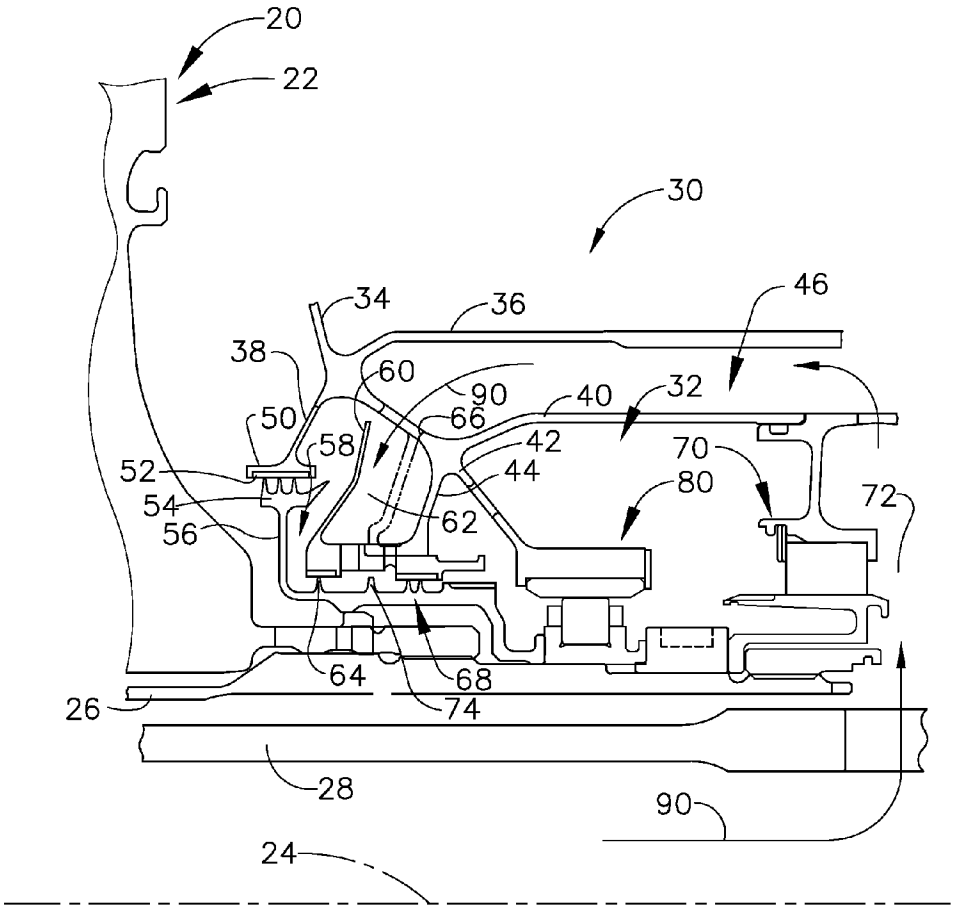
FIG. 2 is a side section view of an example oil sump and related seal structure.

Referring now to FIG. 2, a side view of an aft oil sump area 30 is shown. In the aft area of the turbine engine 10, one or more sumps 32 may be located which service bearings providing for rotation of a radially inner or low pressure shaft 28 and a radially outer shaft or high pressure shaft 26. The high pressure shaft 26 interconnects the high pressure turbine 20 and high pressure compressor 14 while the inner shaft interconnects the low pressure compressor and low pressure turbine. The low pressure shaft 28 extends coaxially through the high pressure shaft 26 and may rotate in either the same direction or opposite that of the high pressure shaft 26. During operation of the turbine engine, the shafts may rotate at different speeds relative to each other.

As shown in FIG. 2, at the left-hand side of the figure, a high pressure turbine 20 is represented by a rotor assembly 22 which is connected to the high pressure shaft 26 extending about the center line axis 24. The rotor assembly 22 forms a portion of the high pressure turbine 20 and rotates with the high pressure shaft 26.

Axially aft of the rotor assembly 22 is an oil sump 32, which is defined by a plurality of generally annular structural members 40, 44 and which may be non-rotating. These members generally define a volume above the high pressure shaft 26 wherein bearing assembly 80 operates and oil is provided for cooling and lubrication of at least one shaft bearing, and a sump pressurization cavity comprising volumes 72, 46, 62 (which may be at least partially defined by structural members 34, 36, 38, 40, 42, 44 and 66) that at least partially surround the sump 32, through which pressurization air 90 is supplied to the sump seals 68, 70. Depending from member 38 is a sump forward air seal land 50 having a rub strip 52 located along a lower surface thereof. Beneath the sump forward air seal land 50 and engaging the rub strip 52 is a sump forward air labyrinth seal 54. Labyrinth seal 54 includes a plurality of seal teeth which extend radially upwardly to engage the rub strip 52. In some example embodiments, adjacent to the seal 54 may be an arm 56 and/or a non-rotatable windage shield 60. Such an arrangement may provide a by-pass passage 62 which may be at least partially separated rotating air created by arm 56.

A pressurization tooth 64 may be disposed on shaft 26 generally radially inward from windage shield 60. To the aft of pressurization tooth 64 is a labyrinth seal 68 which defines a forward seal for the oil sump 32. Pressurization tooth 64 may fluidicly interpose passage 63 and rotatable arm 56 and/or may generally restrict flow of pressurization air 90 from passage 63 towards rotatable arm 56. An aft seal 70 defines an opposite seal for the oil sump 32. Within the sump 32 is a bearing assembly 80, for example a roller bearing assembly at least partially supporting rotatable shaft 26.

As shown in the figure, pressurization air 90 moves radially upwardly into the cavity or flow path 72 aft of the sump 32. The flow 90 moves upwardly through the flow path 72 and through an aperture in the structural member 40 and, for purposes of this description, turns forward relative to the axial direction of the engine 10, generally toward the windage shield 60. In the structural member 42, the flow 90 passes through a member 66 and moves downwardly through the by-pass flow path 62 extending along the aft side of the windage shield 60.

In some applications, it may be desirable that the pressures at the flow path area 72 adjacent to aft seal 70 and the pressure at the labyrinth oil seal 68 be close to equal or that the pressure at the labyrinth oil seal 68 be slightly lower than the pressure at the aft seal 70. The air flow 90 at the seal 68 may help create a barrier to oil movement out from the sump 32. When the pressure differential between aft seal 70 and the forward seal 68 is too high, oil from the sump 32 could leak beyond the forward oil seal 68. Thus, in some example embodiments, the pressure differential around the oil sump 32 may be limited, thereby promoting proper seal performance and promoting oil leakage from the seals.

Some example embodiments may include a widened discourager tooth 74 in the flow path of pressurization air 90 near oil seal 68. Widened discourager tooth may increase the impulse of pressurization air 90 near the seal 68, which may cause oil beyond the seal 68 to move to a drain 65 (FIG. 3), represented in broken line.

Figure 3:
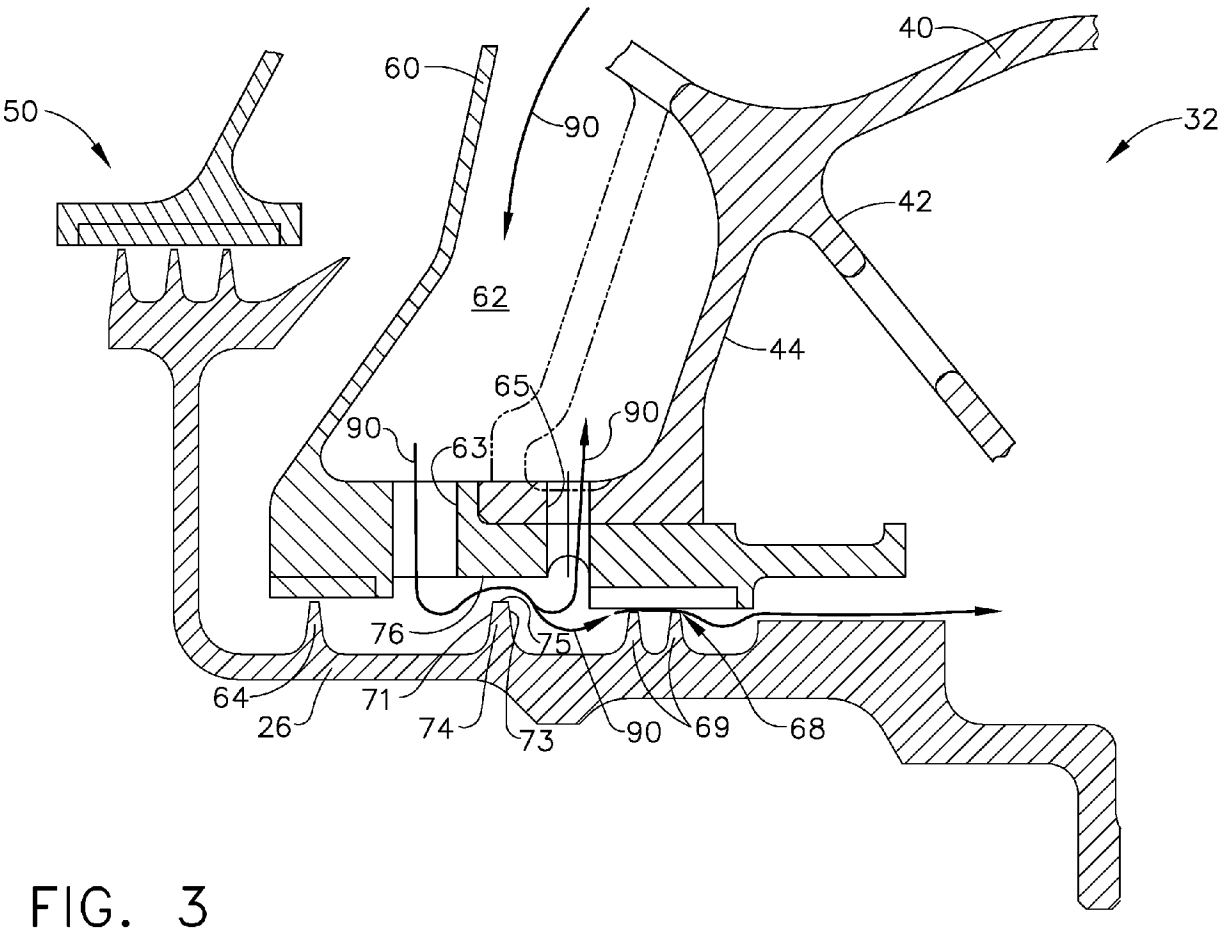
FIG. 3 is a detail section view of a labyrinth oil seal and adjacent discourager tooth which rotates with a high pressure turbine shaft.

Referring now to FIG. 3, a detailed view of the flow of pressurization air 90 at the discourager tooth 74 is depicted adjacent the oil sump 32, The windage shield 60 extends upwardly above a pressurization tooth 64. The detailed figure shows how windage shield 60 directs a portion of the flow of the pressurization air 90 to the aft side of the shield 60 (e.g., by-pass passage 62) and through a passage 63.

As the pressurization air 90 flows aft toward the labyrinth seal 68, pressure is maintained at the seal 68 to at least partially isolate the interior of sump 32 and to prevent oil from sump 32 from moving forward through the seal 68 and leaking. Since the labyrinth seal 68 functions as a seal for the oil sump 32, the pressurized flow 90 on the forward side of the seal 68 (e.g., the outward side of the oil seal with respect to the oil sump) prevents the passage of oil from the aft side of the oil seal 68 to the forward side. Generally, oil seal 68 may operatively act between a non-rotating structural member of the sump (e.g., structural member 44) and rotatable shaft 26.

Disposed between the passage 63 for supplying pressurization air 90 and the oil seal 68 is the discourager tooth 74. The discourager tooth 74 may limit the passage of oil particles that may have leaked past the labyrinth seal 68, and that may tend to flow over the tooth 74 in the direction opposite of the direction of the flow of pressurization air 90. Such passage of oil, in the opposite direction of flow of pressurization air 90, may be undesirable. The discourager tooth 74 may maintain a design gap from an opposed land 76. In some example embodiments, discourager tooth 74 may be sufficiently wide to maintain such gap even during axial excursions of the rotor shaft, which may be normal during operation. In some example embodiments, the gap may be maintained even if a portion of the tooth 74 were to extend axially (either forward or aft) beyond the corresponding stationary land 76.

The discourager tooth 74 may be formed of opposed generally radially extending surfaces 71, 73 which are joined at a radially outward end by a tooth surface 75. The tooth surface 75 may have a width which is at least twice the width of adjacent teeth 64 and teeth 69 of seal 68.

As shown in the figures, the pressurized air 90 passes through the passage 63 and turns aft toward the oil seal 68. After passing over the discourager tooth 74, the air flow pressurizes the teeth 69 of labyrinth seal 68, preventing leakage of oil from the sump 32. It should be noted that while the seal 68 is described, this is exemplary of one area and various other seals and seal types may be utilized in concert with the discourager tooth 74. The pressurized flow 90 is depicted moving through the seal 68 and into the sump 32, for the purpose of limiting oil from passing in the opposite direction of flow 90 (leaking).

However, on occasion it is possible that oil can leak beyond the seal 68. The discourager tooth 74 may provide a barrier to such leakage. During operation, the pressurized air 90 accelerates when passing over the discourager tooth 74. Otherwise stated, the velocity increases in this area. The present disclosure contemplates that the impulse may be regarded as a change in momentum of an object to which a force is applied. This is expressed as $I=F\Delta t=m\Delta v$, where:

I is impulse;

F is the force applied;

t is the time interval over which the force is applied; and, v is the velocity of the object at a time.

Hence, the higher the velocity and longer the duration of the air flowing across the discourager tooth, the more impulse the air can impart on a leaked particle of oil. The longer the region of high velocity air over the tooth surface 75, the greater the time interval t over which the force is applied, and the higher the impulse. As a result, the increased impulse created by the discourager tooth 74 inhibits further forward progression of leaked oil and instead re-directs that oil back through the seal 68 and into the sump 32 or upwardly through an aperture 65 by changing momentum of the particle. Aperture 65 may operate as a drain for leaked oil and/or may vent at least some of the pressurization air 90. Aperture 65 may be positioned axially between passage 63 and oil seal 68. In either event, the leaked oil is handled in a predictable manner.

Figure 4:
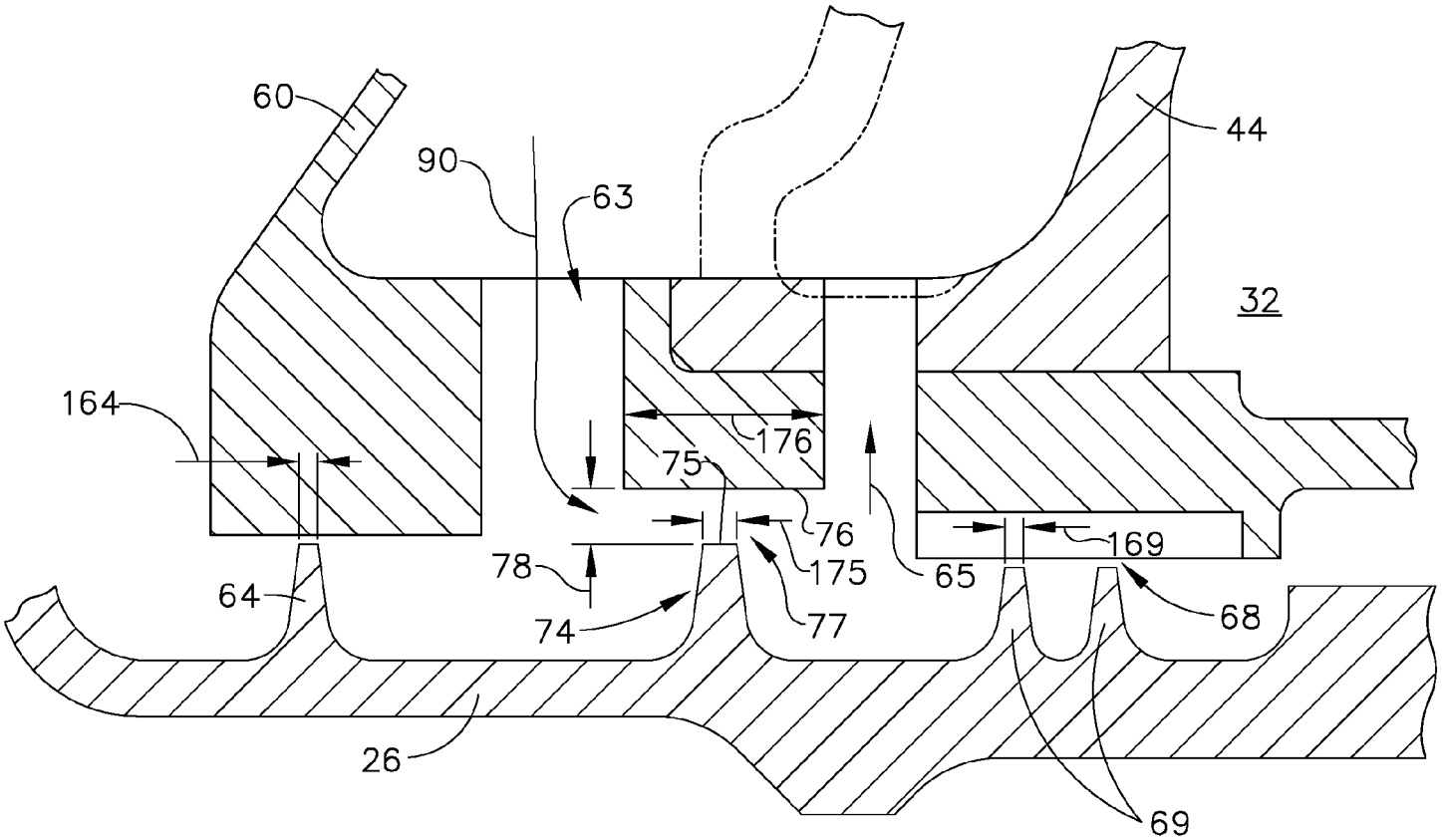
FIG. 4 is a detailed cross section view of an example widened discourager tooth, all in accordance with at least some aspects of the present disclosure.

FIG. 4 is a detailed cross section view of an example widened discourager tooth 74, according to at least some aspects of the present disclosure. Discourager tooth 74 upper tooth surface 75 may have a width 175, which may be measured in a generally axial direction with respect to engine axis 24 (FIG. 1). Discourager tooth 74 may be disposed on shaft 26 and/or may extend generally radially outward towards a non-rotating land 76, which may have a length 176, which may be measured in a generally axial direction with respect to engine axis 24 (FIG. 1). Land 76 may be disposed axially between passage 63 and drain (aperture) 65. Discourager tooth 74 may be spaced apart, in a generally radial direction with respect to engine axis 24 (FIG. 1), from land 76 by a gap 77 having a width 78. Adjacent teeth on high pressure shaft 26 (e.g., pressurization tooth 64 and/or oil seal 68 teeth 69) may have respective widths 164, 169, which may be measured in a generally axial direction with respect to engine axis 24 (FIG. 1).

In some example embodiments, the discourager tooth 74 may be at least about 1.5, 2.0, or 2.5 times the width of adjacent teeth on the high pressure shaft 26, such as the pressurization tooth 64 and the exemplary teeth 69 of the labyrinth seal 68. In other words, in some example embodiments, discourager tooth width 175 may be at least about 1.5 times pressurization tooth width 164 and/or seal tooth width 169. In some example embodiments, discourager tooth width 175 may be at least about 2.0 times pressurization tooth width 164 and/or seal tooth width 169. In some example embodiments, discourager tooth width 175 may be at least about 2.5 times pressurization tooth width 164 and/or seal tooth width 169.

In some example embodiments, the upper tooth surface width 175 may be great enough such that at least some portion of the discourager tooth upper surface 75 will always be substantially directly radially underneath the non-rotating land 76 during any anticipated axial excursion of the rotor shaft 26. Such length may be determinable through engineering methods and analysis known to one skilled in the art. The discourager tooth 74 therefore may compensate for axial excursions which are capable of occurring during operation. For example, the rotor shaft 26 (FIG. 2) due to thermal expansion, rotation, or shocks may move a distance, for example, of 0.1 inches forward. However, prior to the shaft motion due to thermal expansion, rotation, or shock, the aft edge of the upper tooth surface 75 of the exemplary discourager tooth 74 will be more than 0.1 inches from the forward edge of the non-rotating land 76 in a generally axial direction. For example, the rotor shaft 26 (FIG. 2) due to thermal expansion, rotation, or shocks may move a distance, for example, of 0.1 inches aft. However, prior to the shaft motion due to thermal expansion, rotation, or shock, the forward edge of the upper tooth surface 75 of the exemplary discourager tooth 74 will be more than 0.1 inches from the aft edge of the non-rotating land 76 in a generally axial direction. Therefore, while a portion of the tooth surface 75 may extend beyond the land 76 in a fore or aft direction, the width 78 of design gap 77 between the discourager tooth 74 and land 76 may still be maintained. As a result, flow of pressurization air 90 through gap 77 may be generally more consistent (e.g., pressure loss and/or velocity), which contribute to more predictable oil seal 68 performance.

As an unexpected result, in some example embodiments, the stationary land 76 opposite the discourager tooth 74 may need not be longer than usual. As this was a method of compensating for the axial excursion, such method led to longer parts which in turn meant higher weights. However, some example embodiments according to at least some aspects of the present disclosure may allow shortening of the stationary parts without loss of the design gap, as described herein.

According to some example embodiments, the discourager tooth 74 comprises opposed sides extending to an upper tooth surface 75. The upper tooth surface 75 may be wider (e.g., at least twice the width) than adjacent seal 68 teeth 69 and/or a pressurization tooth 64. The upper tooth surface 75 may be designed with an axial length (e.g., width 175) such that at least some portion of the discourager tooth land 75 will be substantially directly radially underneath the non-rotating land 76 during any anticipated axial excursion of the rotor shaft 26. Opposite the discourager tooth may be a land 76 defining a radial design gap 77 between the surface 75 and the land 76. The discourager tooth 74 increases velocity of pressurized air passing adjacent the upper tooth surface 75 and maintains the air at that higher velocity for a longer duration of time than previous designs, resulting in an increase in impulse on oil particles that may have leaked through the oil seal 68. Additionally the wide discourager tooth 74 may compensate for axial excursions to minimize pressure loss and maintain a more consistent pressure at the oil seal 68 during such excursions.

In some example embodiments, a ratio of discourager tooth width 175 to gap width 78 may be greater than about 0.5. In some example embodiments, a ratio of discourager tooth width 175 to gap width 78 may be greater than about 1.0. In some example embodiments, a ratio of discourager tooth width 175 to gap width 78 may be greater than about 4.0.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Examples are used to disclose the embodiments, including the best mode, and also to enable any person skilled in the art to practice the apparatus and/or method, including making and using any devices or systems and performing any incorporated methods. These examples are not intended to be exhaustive or to limit the disclosure to the precise steps and/or forms disclosed, and many modifications and variations are possible in light of the above teaching. Features described herein may be combined in any combination. Steps of a method described herein may be performed in any sequence that is physically possible.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An oil sump seal pressurization apparatus for a turbine engine, the oil sump seal pressurization apparatus comprising:

a non-rotating oil sump housing a bearing, the bearing supporting a rotatable shaft;

an oil seal at least partially isolating an interior of the oil sump, the oil seal operatively acting between a non-rotating structural member of the sump and the rotatable shaft;

a passage arranged to supply pressurization air to an outward side of the oil seal with respect to the oil sump;

a drain arranged to allow draining of oil and venting of at least some of the pressurization air, the drain being positioned axially between the passage and the oil seal;

a discourager tooth disposed on the shaft and extending radially outward towards a non-rotating land, the land being disposed axially between the passage and the drain, the discourager tooth being spaced apart from the land in a generally radial direction by a design gap having a width, the discourager tooth including an upper surface having a width; and a first adjacent tooth disposed on the shaft and extending radially outward from the shaft, the first adjacent tooth having a width;

wherein the discourager tooth width is at least about 1.5 times the width of the first adjacent tooth.

2. The oil sump seal pressurization apparatus of claim 1, wherein the discourager tooth width is at least about 2.0 times the width of the first adjacent tooth.

3. The oil sump seal pressurization apparatus of claim 1, wherein the discourager tooth width is at least about 2.5 times the width of the first adjacent tooth.

4. The oil sump seal pressurization apparatus of claim 1, further comprising a second adjacent tooth disposed on an axially opposite side of the discourager tooth;

wherein the discourager tooth width is at least about 1.5 times the width of the first adjacent tooth and the discourager tooth width is at least about 1.5 times a width of the second adjacent tooth.

5. The oil sump seal pressurization apparatus of claim 1, further comprising a second adjacent tooth disposed on an axially opposite side of the discourager tooth;

wherein the discourager tooth width is at least about 2.0 times the width of the first adjacent tooth and the discourager tooth width is at least about 2.0 times a width of the second adjacent tooth.

6. The oil sump seal pressurization apparatus of claim 1, further comprising a second adjacent tooth disposed on an axially opposite side of the discourager tooth;

wherein the discourager tooth width is at least about 2.5 times the width of the first adjacent tooth and the discourager tooth width is at least about 2.5 times a width of the second adjacent tooth.

7. The oil sump seal pressurization apparatus of claim 1, wherein a ratio of discourager tooth width to design gap width is greater than about 0.5.

8. The oil sump seal pressurization apparatus of claim 1, wherein the ratio of discourager tooth width to design gap width is greater than about 1.0.

9. The oil sump seal pressurization apparatus of claim 1, wherein the ratio of discourager tooth width to design gap width is greater than about 4.0.

10. An oil sump seal pressurization apparatus for a turbine engine, the oil sump seal pressurization apparatus comprising:

a non-rotating oil sump housing a bearing, the bearing supporting a rotatable shaft;

an oil seal at least partially isolating an interior of the oil sump, the oil seal operatively acting between a non-rotating structural member of the sump and the rotatable shaft;

a passage arranged to supply pressurization air to an outward side of the oil seal with respect to the oil sump;

a drain arranged to allow draining of oil and venting of at least some of the pressurization air, the drain being positioned axially between the passage and the oil seal; and a discourager tooth disposed on the shaft and extending radially outward towards a non-rotating land, the land being disposed axially between the passage and the drain, the discourager tooth being spaced apart from the land in a generally radial direction by a design gap having a width, the discourager tooth including an upper surface having a width;

wherein a ratio of discourager tooth width to design gap width is greater than about 0.5.

11. The oil sump seal pressurization apparatus of claim 10, wherein the ratio of discourager tooth width to design gap width is greater than about 1.0.

12. The oil sump seal pressurization apparatus of claim 10, wherein the ratio of discourager tooth width to design gap width is greater than about 4.0.

13. The oil sump seal pressurization apparatus of claim 10, further comprising a first adjacent tooth disposed on the shaft and extending radially outward from the shaft;

wherein the discourager tooth width is at least about 1.5 times a width of the first adjacent tooth.

14. The oil sump seal pressurization apparatus of claim 13, further comprising a second adjacent tooth disposed on an axially opposite side of the discourager tooth;

wherein the discourager tooth width is at least about 1.5 times the width of the first adjacent tooth and the discourager tooth width is at least about 1.5 times a width of the second adjacent tooth.

15. The oil sump seal pressurization apparatus of claim 10, further comprising a first adjacent tooth disposed on the shaft and extending radially outward from the shaft;

wherein the discourager tooth width is at least about 2.0 times the width of the first adjacent tooth.

16. The oil sump seal pressurization apparatus of claim 15, further comprising a second adjacent tooth disposed on an axially opposite side of the discourager tooth;

wherein the discourager tooth width is at least about 2.0 times the width of the first adjacent tooth and the discourager tooth width is at least about 2.0 times a width of the second adjacent tooth.

17. The oil sump seal pressurization apparatus of claim 10, further comprising a first adjacent tooth disposed on the shaft and extending radially outward from the shaft;

wherein the discourager tooth width is at least about 2.5 times the width of the first adjacent tooth.

18. The oil sump seal pressurization apparatus of claim 17, further comprising a second adjacent tooth disposed on an axially opposite side of the discourager tooth;

wherein the discourager tooth width is at least about 2.5 times the width of the first adjacent tooth and the discourager tooth width is at least about 2.5 times a width of the second adjacent tooth.

* * * * *